US005570520A

United States Patent [19]

Huffington

[11] Patent Number: 5,570,520

[45] Date of Patent: Nov. 5, 1996

[54] CLOTHES DRYER DRYNESS DETECTION SYSTEM

[75] Inventor: Jeffrey M. Huffington, Cary, Ill.

[73] Assignee: Eaton Corporation, Cleveland, Ohio

[21] Appl. No.: 443,588

[22] Filed: May 17, 1995

[51] Int. Cl.[6] ..... F26B 13/10

[52] U.S. Cl. ..... 34/535; 34/557; 34/491

[58] Field of Search ..... 34/535, 557, 491, 34/493, 495

[56] References Cited

U.S. PATENT DOCUMENTS

| | | | |
|---|---|---|---|
| 3,224,107 | 12/1965 | Chafee, Jr. . | |
| 3,391,468 | 7/1968 | Walker . | |
| 3,507,054 | 4/1970 | Janke . | |
| 3,864,844 | 2/1975 | Heidtmann . | |
| 3,942,265 | 3/1976 | Sisler et al. . | |
| 4,412,389 | 11/1983 | Kruger | 34/535 |
| 5,035,117 | 7/1991 | Drake | 34/493 |
| 5,226,241 | 7/1993 | Goodwin | 34/493 |
| 5,291,667 | 3/1994 | Joslin et al. | 34/535 |
| 5,404,656 | 4/1995 | Matsuda et al. | 34/535 |
| 5,456,025 | 10/1995 | Joiner et al. | 34/535 |

*Primary Examiner*—John T. Kwon

*Attorney, Agent, or Firm*—Fay, Sharpe, Beall, Fagan, Minnich & McKee

[57] ABSTRACT

In a clothes dryer, the air exiting the dryer for wet clothes has a high relative humidity compared to the relative humidity when the load is dry. A change in the relative humidity of the air leaving the dryer indicates a change in dryness of the load. The relative humidity is measured by using two thermistors located in an air outlet of the dryer. The first thermistor is nonself-heating and uses a relatively low current to detect the temperature of the air in the air outlet. The second thermistor is self-heating and operates at a higher current so that its temperature is higher than the air temperature. As the air moves across the heated thermistor it will conduct more heat away from the thermistor when the relative humidity of the air is high than when it is low. The air temperature and heated thermistor temperature are compared frequently during the drying cycle. When the load is wet the difference between the two thermistors is small. When the load is dry the difference is greater. A microcontroller circuit controls the temperature sensing and difference computation.

7 Claims, 2 Drawing Sheets

CLOTHES DRYER DRYNESS DETECTION SYSTEM

BACKGROUND OF THE INVENTION

This application pertains to the art of control systems, and more particularly to microprocessor based systems for controlling an energy source in response to sensed changes in parameters affected by the energy source.

The invention is particularly applicable to a clothes dryer dryness detection system and will be described with specific reference thereto. However, it will be appreciated that the invention has broader applications such as other control systems where changes in relative humidity or temperature are monitored as a control parameter and may be advantageously employed in such other environments and applications.

Clothes dryers are relatively well-known and common household appliances. They are automatic machines in the sense that the operator need only load the dryer and the dryer will turn itseft off after expiration of a preset drying time. An option on such dryers which has become popular recently is an automatic dryness control circuit which can sense whether the clothes in the dryer are actually dry instead of merely running for a preprogrammed time length. This further relieves the operator of the worry of either over-drying or under-drying of a clothes load, which can of course always vary depending upon the size and content of the load. The improved detection of dryness of the load is the overall objective of the subject application.

Dryness detection circuits for clothes dryers have heretofore comprised primarily two types. The first type employs contact traces in the rotating drum of the dryer, while the second employs a bi-metal thermostat to detect exit air temperature.

The trace contact systems comprise a hybrid (electromechanical) control system where electrical tracings in the dryer drum are intended to actually contact clothes contained therein. Opposed traces are set relatively close together so that if a wet item in the load makes contact with it a closed circuit connection is made across the traces. The control theory of this system is that every time a continuity occurs across the traces, a circuit will count the number of circuit closing as pulses which then can be communicated to a signal conditioning circuit. Based upon the number of pulses that are counted within a predetermined period of time, the relative dryness of the load in the dryer is determined. Typically, the frequency of the pulses are used to condition a signal to charge a capacitor, which, as long as it is maintained at a threshold, indicates that the clothes in the load are not yet dry. When the pulse frequency fails to maintain the capacitor threshold, a timer is initiated to count down a predetermined timeout period for the end of the drying cycle.

Another control system also employing traces merely counts the number of pulses with a microprocessor circuit and uses a predetermined algorithm to compare the counted pulses within a set period to a stored "dryness table" in a memory. In other words, a user merely presets the relative level of dryness desired for the load and, based upon the counted pulses of circuit closures across the traces, in comparison with the predetermined table, the relative dryness is detected.

In accordance with the second type of control system, contact traces are avoided in the drum and a thermostat senses the temperature of the exit air. Experience with clothes dryers has show that for a typical drying operation, a plot of time versus temperature shows that there will be a long plateau where the temperature is fairly constant during the drying operation of the clothes. After the moisture has been substantially evaporated so that the clothes are almost dry, the temperature on the plot will substantially increase. Exit air temperature systems will detect this inflection in the exiting air temperature and will also then turn on a timeout timer for the timeout of the drying cycle.

The problems which have been found with regard to the use of these two prior systems basically fall into ones of cost and reliability. The home appliance industry is so cost competitive that even seemingly minor reductions in component costs can present a substantial advantage in high volume product marketing. Suppliers of the components to the assemblers and manufactures of such dryers are under constant pressure to continually maintain or reduce the costs of such supplied components. Secondly, reliability in operation, both from longevity and durability standpoint, as well as an accuracy standpoint is of very high concern. The required dryness time to be employed by a clothes dryer will vary with load size, type of fabric, amount of moisture in the load, rate of evaporation, the way the clothes tumble and the amount of air flowing in the load, as well as the ambient room temperature. Any successful dryness detection system must be able to adapt to these varying conditions. Predetermined timeout tables are usually merely an experimentally based averaging of these varying conditions and cannot possibly encompass all possible condition sets. Reliability thus suffers. In addition, pulse counting of trace wire continuities is inherently unreliable since wet clothes in the dryer may simply miss the contacts enough to give an improper indication of clothes dryness.

Thermostat based systems for detecting temperature also have a problem with reliability in that the simply do not measure the dryness of the clothes. Rather, they measure a parameter which is hopefully representative of clothes dryness but due to the vagaries of the varying conditions noted above, such a system may not be as accurate as desired, particularly, one based on an averaging of predetermined experimental results.

Lastly, all prior art systems have the problem of cost. For those systems which employ printed circuit boards, as the systems above do, such items are relative high-cost devices, not only for their inherent cost themselves, but also for the cost of installation and assembly.

The present invention contemplates a new and improved control system and method which overcomes the above referred to problems and others to provide a new clothes dryer dryness detection system which is simple in design, economical to manufacture, readily adaptable to a plurality of load conditions including load size, type of fabric, amount of moisture in the load, rate of evaporation, varying clothes tumble, the amount of air flowing through the load and ambient temperature, and thus provides improved efficiencies in operation and reductions in manufacturing costs.

BRIEF SUMMARY OF THE INVENTION

In accordance with the present invention, there is provided a system for detecting dryness in exit air from a clothes dryer based upon detecting a change in the relative humidity of the exit air. The system comprises a first thermistor disposed in an air outlet of the clothes dryer for exposure to the exit air and operating at a conventional current for detecting a first parameter representative of the temperature of the exit air. A second, self heating thermistor is similarly disposed in the air outlet for exposure to the exit air operates at a relatively high current for detecting a second parameter representative of a higher temperature than the actual temperature of the exit air. The thermistor is a resistive device which dissipates power as heat. When a relatively high current is sent through it, it will run at a higher temperature than the first thermistor. However, if there is a high moisture content in the exit air, the exit air will pull heat away from the self-heating thermistor faster than if the exit air were dry air. The second thermistor thus comprises a detection device for detecting a second parameter which will adjust in response to ambient relative humidity of the exit air so that a lower temperature is represented by the self-heating thermistor when the relative humidity of the exit air is high. A circuit is coupled to the thermistors for comparing the first and second parameters and computing a relative difference (Δ) between them. During the normal drying portion of the drying cycle, Δ remains constant due to the high moisture content of the exit air. However, when the exit air becomes dryer, because the moisture content of the clothes has been evaporated, the second parameter from the self-heating thermistor will indicate that a parameter representative of a higher temperature of the self-heating thermistor exists and the Δ will become greater between the two parameters. In other words, the relative difference between temperatures sensed by the two thermistors will become farther apart as the clothes in the clothes dryer dry out. The inflection in the A is used to detect the dryness of the load.

In accordance with another aspect of the present invention, the control circuit comprises a microprocessor-based voltage divider circuit in association with the two thermistors. A relative difference in the measured voltages across the thermistor remains substantially constant during the drying cycle when the clothes in the dryer have a high moisture content. As the clothes dry out, the relative different makes a significant and detectable change indicating that the clothes are drying out. The control circuit shuts off the dryer operation when the detectable difference has reached a predetermined level.

One benefit obtained by use of the present invention is a dryness detection control system which actually measures a parameter representative of a relative humidity of the exit air of a dryer.

Another benefit of the subject invention is a system which avoids use of trace wires secured to a rotating drum of a dryer.

A further benefit of the present invention is an all electronic control system which is reliable, but has a reduced production cost over prior known systems.

Other benefits and advantages of the subject new control system will become apparent to those skilled in the art upon a reading and understanding of this specification.

BRIEF DESCRIPTION OF THE DRAWINGS

The invention may take physical form in certain parts and arrangements of parts, the preferred embodiments of which will be described in detailed in this specification and illustrated in the accompanying drawings which form a part hereof and wherein.

DETAILED DESCRIPTION OF THE INVENTION

Figure 1:
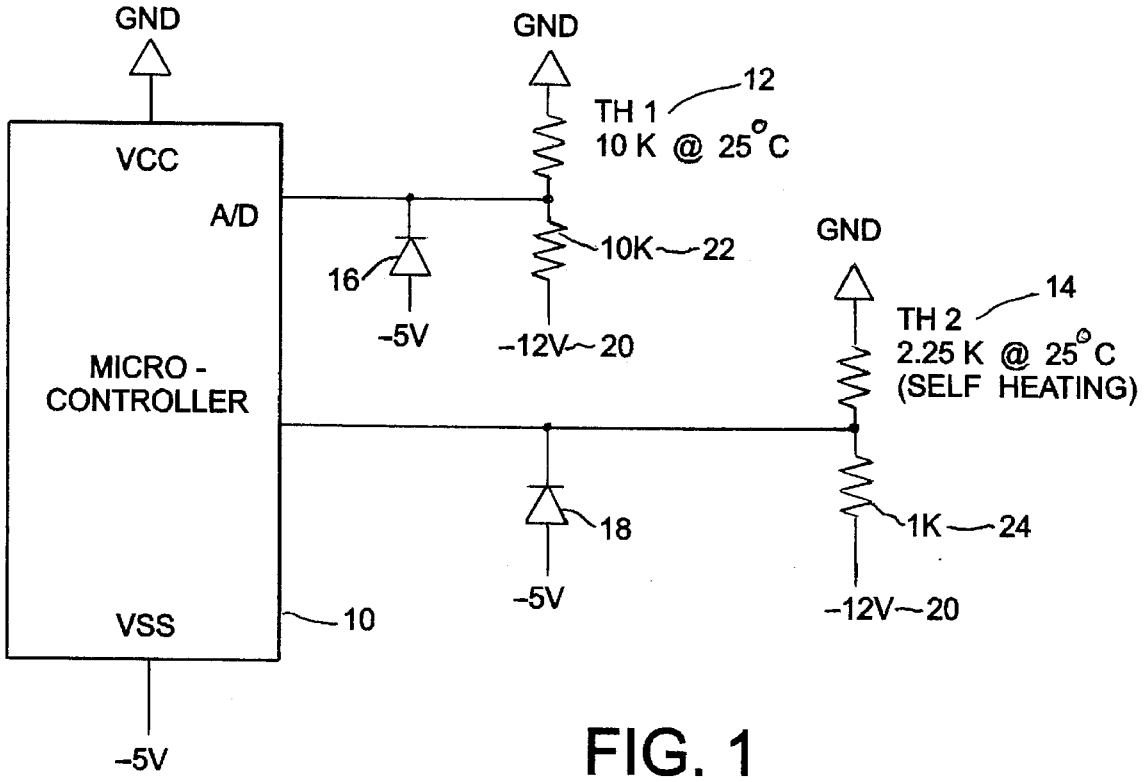
FIG. 1 is a circuit diagram of a control system formed in accordance with the present invention.

Referring now to the drawings wherein the showings are for purposes of illustrating the preferred embodiments of the invention only and not for purposes of limiting same, FIG. 1 shows a circuit diagram of a clothes dryer detection circuit comprising a microcontroller 10 in operative communication with a first nonself-heating thermistor 12 and a second self-heating thermistor 14. First and second clamping diodes 16, 18 protect the microcontroller 10 from the 12 volt supply voltages 20 to the thermistors in case the thermistors were to become an open circuit. The first thermistor 12 is associated with a first resistor 22 and the second thermistor is associated with a second resistor 24. The relative differences in sizes between the resistors 22, 24 is that resistor 22 is approximately ten times the size of resistor 24 to assure that the current load through the second thermistor is approximately ten times greater than the current load through the first thermistor.

The microcontroller 10 preferably comprises a conventionally available microcontroller device suitable for converting an analog parameter detected by the circuit to digital signals for appropriate signal processing. In this case an Hitachi 4314 would adequately accomplish the desired task. The first thermistor is preferably rated for 10k ohms at 25° C. and the second thermistor, or self-heating thermistor, is rated for 2.25k ohms at 25° C.

Figure 3:
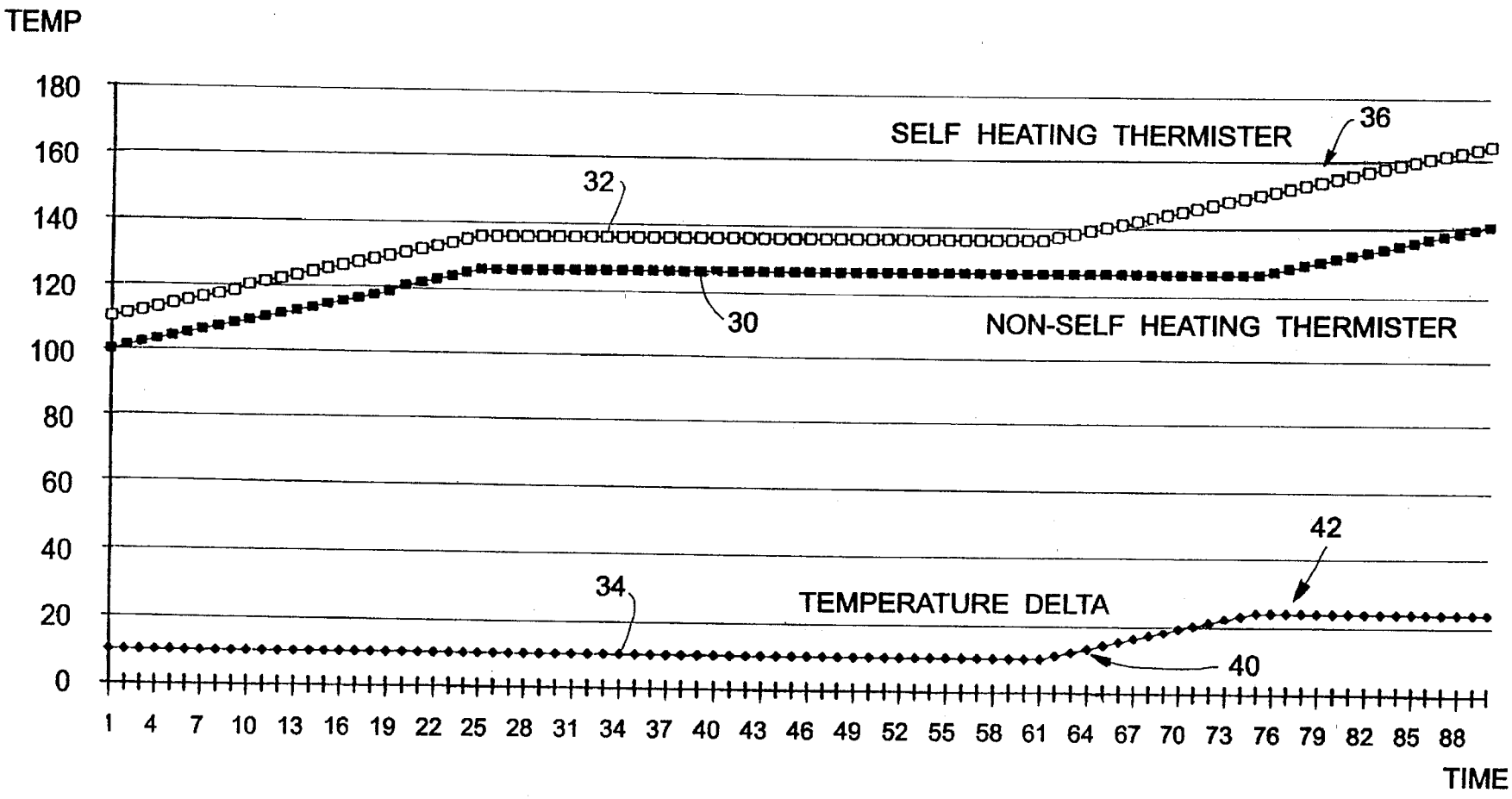

The thermistors 12, 14 are set in the exit air ducts or outlets (not shown) of a clothes dryer. As can be seen with reference to FIG. 3, each of the thermistors provides a temperature plot of ambient air temperature for the exit air in the air outlet. The non self-heating thermistor 12 has a temperature plot 30, and merely measures the ambient temperature. The relative humidity of the exit air has little effect on thermistor 12. However, the temperature plot 32 for the self-heating thermistor 14 shows a higher temperature than the non self-heating thermistor 30. This is because the self-heating thermistor has a higher current being run through it so that it can dissipate power as heat to additionally heat itself up, but when there is a lot of moisture content in the exit air, the exit air passing over the self-heating thermistor 14 will pull heat away from it faster than if the exit air were dry air. The temperature Δ plot 34, which is a computation of the difference between the plots 30 and 32, shows that there is a constant temperature difference between the sensed temperatures of the thermistors until a certain portion of the Δ changes due to an inflection of the self-heating thermistor plot 32 at a portion 36. It can be seen that at approximately time unit 62 the self-heating thermistor plot begins to indicate a higher temperature of the exit air, while the non self-heating thermistor maintains a constant temperature level. At this point, (indicated at 40 on plot 34) the relative humidity of the exit air is beginning to drop. At point 42 on the temperature Δ curve 34, it can be seen that the Δ has again returned to a relatively constant level indicative that the moisture content of the exit air is once again constant and in fact, that the clothes in the clothes dryer have now become dry.

The relative dryness of a clothes load can be selected by a user by presenting termination of the drying cycle at a point sometime between points 40 and 42 of temperature Δ curve 34. At point 42, the maximum and full dryness will occur, while at point 40 dryness is at a minimum level. Such relative dryness can be selected by a user in association with a predetermined program operation stored in the microcontroller 10.

The actual operation of the control circuit 10 is essentially a voltage divider circuit which measures the voltage drop across the thermistors as an analog signal and converts it to a digital signal for conventional digital signal processing. It will be appreciated that, as the exit air cools the self-heating thermistor due to a high relative humidity content, the resistance of the thermistor will increase so that the voltage drop across a thermistor 14 will be greater than when the thermistor is operating at a higher temperature. Such thermistor operation is of course completely conventional; however, its application for ultimately sensing relative humidity of exit air in a clothes dryer is believed to be completely novel.

Figure 2:
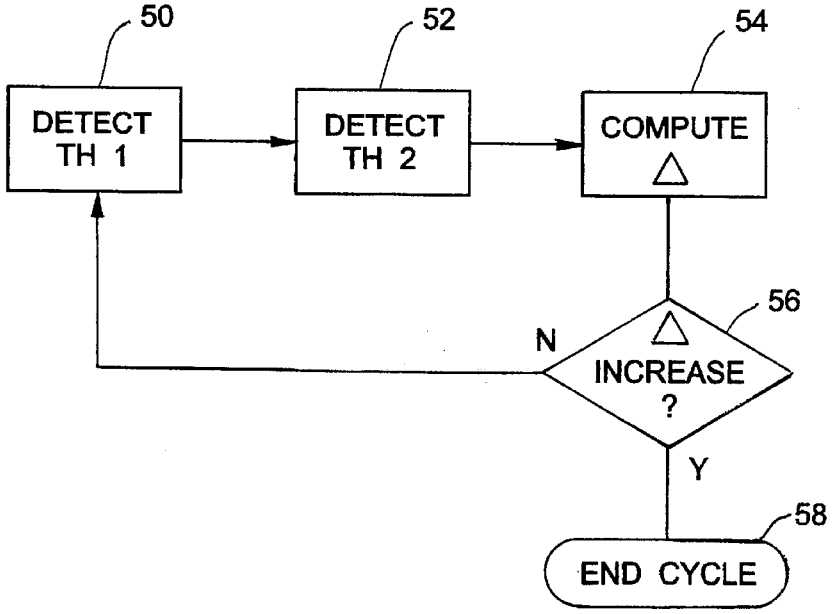
FIG. 2 is a block diagram illustrating the control steps for implementing the subject invention; and, FIG. 3 is a plot of temperature versus time data for the thermistors employed in the subject invention.

The processing steps of the microcontroller 10 are illustrated in FIG. 2, wherein steps 50 and 52 comprise a regular detection of the exit air temperature at 50 and the heated thermistor temperature at 52, so that they can be compared frequently during the drying cycle at the Δ computation step 54. When the load is wet, the difference in temperature between the two thermistors is relatively smaller than when the load is dry, as noted above with reference to FIG. 3. When the Δ increases, or temperature difference change has occurred to a pre-desired point set by a user as indicated at step 46, then the drying cycle should be ended as at 58. If the predetermined temperature Δ point has not been reached, the detection circuit continues to operate and the clothes are continued to be dried.

The invention has been described with reference to a preferred embodiment. Obviously, modifications and alterations will occur to others upon a reading and understanding of the specification. It is my intention to include all such modifications and alterations insofar as they come within the scope of the appended claims or the equivalents thereof.

Having thus described my invention, I now claim:

1. A system for detecting dryness of exit air from a clothes dryer comprising:

a first thermistor disposed in an air outlet of the clothes dryer for exposure to ambient exit air for detecting a first parameter representative of a temperature of the exit air;

a second self-heating thermistor similarly disposed in the air outlet for detecting a second parameter representative of a higher temperature than the temperature of the exit air and wherein said second thermistor further comprises a means for adjusting said second parameter in response to relative humidity of said exit air for representing a lower temperature than said higher temperature when a relative humidity of said exit air is high; and, circuit means coupled to said thermistors for comparing said first and second parameters and responsive to a predetermined relationship between said parameters for detecting dryness of said exit air.

2. The system as defined in claim 1 further including means for operating said second thermistor at a higher relative current than said first thermistor for inducing said second parameter.

3. The system as defined in claim 1 wherein said circuit means comprises a signal processor for converting a relative difference in voltage drops across the first and second thermistors into a temperature delta.

4. The system as defined in claim 3 wherein the predetermined relationship comprises an increase in the temperature delta.

5. A method of detecting a change in relative humidity of an air stream passing through an air duct wherein a non-self heating thermistor and a self heating thermistor are disposed in the air duct for detecting respective parameters representative of air temperature in the air duct comprising steps of:

conducting a first current through the non-self heating thermistor to detect a first parameter representative of the air stream temperature;

conducting a second current through the self heating thermistor to detect a second parameter representative of a higher temperature than the air stream temperature;

computing a relative difference between said first and second parameters; and, detecting an inflection in said relative difference as representative of the change in relative humidity.

6. The method as defined in claim 5 wherein said detecting comprises identifying an increase in said relative difference as representative of an increase in dryness of said air stream.

7. The method as defined in claim 5 wherein the detection of said first and second parameters comprises measuring first and second voltage drops across said thermistors, respectively.

* * * * *